US009151062B2

(12) United States Patent
Cappelle et al.

(10) Patent No.: US 9,151,062 B2
(45) Date of Patent: Oct. 6, 2015

(54) FLOOR PANELS, FLOOR COVERING COMPOSED THEREOF, AND METHOD FOR MANUFACTURING SUCH FLOOR PANELS

(75) Inventors: Mark Cappelle, Staden (BE); Bernard Thiers, Eine (BE)

(73) Assignee: FLOORING INDUSTRIES LIMITED, SARL, Bertrange (LU)

( * ) Notice: Subject to any disclaimer, the term of this patent is extended or adjusted under 35 U.S.C. 154(b) by 730 days.

(21) Appl. No.: 12/934,874

(22) PCT Filed: Mar. 3, 2009

(86) PCT No.: PCT/IB2009/050854
§ 371 (c)(1),
(2), (4) Date: Sep. 27, 2010

(87) PCT Pub. No.: WO2009/127977
PCT Pub. Date: Oct. 22, 2009

(65) Prior Publication Data

US 2011/0011026 A1 Jan. 20, 2011

(51) Int. Cl.

| | |
|---|---|
| ***E04B 5/02*** | (2006.01) |
| ***E04B 5/23*** | (2006.01) |
| ***E04F 15/02*** | (2006.01) |

(Continued)

(52) U.S. Cl.
CPC ..... *E04F 15/02005* (2013.01); *E04F 15/02* (2013.01); *E04F 15/04* (2013.01); *E04B 5/00* (2013.01); *E04B 5/02* (2013.01); *E04F 2201/0107* (2013.01); *Y10T 29/49629* (2015.01)

(58) Field of Classification Search
CPC ..... E04B 5/00; E04B 5/02; E04B 5/16; E04B 5/23; E04B 5/43; E04F 2201/0588; E04F 2201/0115; E04F 15/02038; E04F 2201/0535; E04F 13/0894; E04F 2201/0523; E04F 2201/0146; E04F 2201/0176; E04C 2/20
USPC ..... 52/588.1, 591.5, 581, 578, 582.1, 52/589.1, 590.2, 590.3, 592.2, 745.08, 52/745.17, 747.1; 403/345, 364, 365, 366
See application file for complete search history.

(56) References Cited

U.S. PATENT DOCUMENTS

| | | | | |
|---|---|---|---|---|
| 4,599,841 | A | 7/1986 | Haid | |
| 6,682,254 | B1 * | 1/2004 | Olofsson et al. | 403/375 |
| 6,880,305 | B2 * | 4/2005 | Pervan et al. | 52/480 |

(Continued)

FOREIGN PATENT DOCUMENTS

| | | | |
|---|---|---|---|
| DE | 20109840 | U1 | 10/2001 |
| DE | 10064587 | A1 | 7/2002 |

(Continued)

OTHER PUBLICATIONS

International Search Report in PCT/IB2009/050854, Jul. 2, 2009.

(Continued)

*Primary Examiner* — Phi A
(74) *Attorney, Agent, or Firm* — Workman Nydegger

(57) ABSTRACT

Floor panel comprising coupling parts enabling two floor panels to adopt two or more different mutually locked positions (P1-P2) when coupled, wherein the two or more mutual positions (P1-P2) differ from each other in that they, at the coupled sides, define two or more different distances (S) between the upper side edges of the floor panels, and adapter elements are provided with the coupling parts, so that the use or non-use of these adapter elements enables setting the mutually locked position (P1-P2).

24 Claims, 3 Drawing Sheets

(51) Int. Cl.
*E04F 15/04* (2006.01)
*E04B 5/00* (2006.01)

(56) References Cited

U.S. PATENT DOCUMENTS

| | | | | |
|---|---|---|---|---|
| 8,261,508 | B2 * | 9/2012 | Thiers | 52/592.1 |
| 8,302,361 | B2 * | 11/2012 | Braun et al. | 52/588.1 |
| 2003/0101681 | A1 * | 6/2003 | Tychsen | 52/783.1 |
| 2004/0168392 | A1 | 9/2004 | Konzelmann et al. | |
| 2005/0166513 | A1 * | 8/2005 | Vanderhoef | 52/578 |
| 2007/0094985 | A1 | 5/2007 | Grafenauer | |
| 2008/0263987 | A1 | 10/2008 | Leopolder et al. | |
| 2009/0000232 | A1 * | 1/2009 | Thiers et al. | 52/588.1 |
| 2009/0100782 | A1 * | 4/2009 | Groeke et al. | 52/589.1 |
| 2009/0260313 | A1 * | 10/2009 | Segaert | 52/592.1 |
| 2012/0222378 | A1 * | 9/2012 | Cappelle et al. | 52/309.1 |

FOREIGN PATENT DOCUMENTS

| | | | | | |
|---|---|---|---|---|---|
| DE | 202006005470 | U1 | | 8/2006 | |
| EP | 0121915 | A2 | | 10/1984 | |
| EP | 1359266 | A2 | * | 11/2003 | E04F 15/04 |
| EP | 1767724 | A1 | | 3/2007 | |
| GB | 2065744 | A | * | 7/1981 | E04C 2/00 |
| GB | 2168732 | A | * | 6/1986 | E04C 2/26 |
| WO | 94/26999 | | | 11/1994 | |
| WO | 97/47834 | | | 12/1997 | |
| WO | 01/27410 | A1 | | 4/2001 | |
| WO | 01/96688 | A1 | | 12/2001 | |
| WO | 01/98603 | A2 | | 12/2001 | |
| WO | 2004/048716 | A1 | | 6/2004 | |
| WO | 2005/003489 | A1 | | 1/2005 | |
| WO | 2005/124052 | A1 | | 12/2005 | |
| WO | 2007/113676 | A2 | | 10/2007 | |
| WO | 2007/144403 | A1 | | 12/2007 | |
| WO | 2008/053333 | A2 | | 5/2008 | |
| WO | 2008/088239 | A1 | | 7/2008 | |

OTHER PUBLICATIONS

Search Report of European Patent Office Regarding Belgium Patent Application No. 200810232, Oct. 17, 2008.

* cited by examiner

FLOOR PANELS, FLOOR COVERING COMPOSED THEREOF, AND METHOD FOR MANUFACTURING SUCH FLOOR PANELS

BACKGROUND OF THE INVENTION

1. Field of the Invention

This invention relates to floor panels, a floor covering composed thereof, and a method for manufacturing such floor panels.

2. Related Art

More particularly, the invention relates to floor panels, which are intended for forming a floating floor covering and which, when being installed, can be coupled to each other at their edges by means of mechanical coupling parts, whether or not made in one piece with the floor panel, which coupling parts provide for a mutual locking of the floor panels in horizontal as well as in vertical direction, for example, as described in the international patent applications WO 94/26999, WO 97/47834, WO 01/98603 and WO 01/96688.

In the meantime, it is also known to realize such floor panels in such a manner that they, when being coupled, show gaps, bevels or other chamfers at their edges. To this aim, reference is made to WO 2007/113676 and the already mentioned WO 01/96688, respectively. It is noted that in the case of bevels, the same kind of floor panel, which means, for example, a natural varnished oak floor panel of the same manufacturer, is offered both with and without a bevel in order to accommodate the different likings of the client. The same duplication of the number of products seems necessary when floor panels with or without gaps have to be offered.

From WO 2005/124052, it is known in the meantime to realize the coupling means of wall and ceiling panels in such a manner that they can be coupled to each other in two different manners, wherein then, depending on the manner of coupling, a recess is or is not present between the edges of both wall or ceiling panels. A similar system is presented by the present applicant in the international patent application PCT/IB2007/003310, which had not yet been published when the present application was filed. Such systems, however, have the disadvantage that the manner of coupling and, thus, the presence or absence of a recess or a gap between the panels, is left to the user when installing each panel. Such system is time-consuming, as it hampers the smoothness with which such panels can be installed. Moreover, such system may induce installation faults. Also, with such system it is difficult to obtain a gap of limited size.

SUMMARY OF THE DISCLOSURE

The present invention aims at alternative floor panels, which, according to various preferred embodiments, offer a solution for one or more of the above-mentioned disadvantages of the state of the art.

To this aim, the invention, according to its first aspect, relates to a floor panel of the type comprising at least at two opposite sides coupling means allowing that two of such floor panels can adopt two or more different mutually locked positions, wherein, in these mutual positions, they can be coupled to each other, such that therein a locking is obtained in a vertical direction perpendicular to the plane of the floor panels, as well as in a horizontal direction in the plane of the floor panels and perpendicular to the coupled edges, wherein said two or more mutual positions differ from each other in that they, at the coupled sides, define two or more different distances between the upper edges of the floor panels, with the characteristic that adapting means are present at said coupling means, wherein the application or non-application of these adapting means allows setting the mutually locked position to be adopted.

Due to the fact that the adapting means allow a setting of the locked position to be adopted, faults during installation of the floor panels can be avoided. Namely, the user can "set" which of the two or more possible, mutually locked positions shall be obtained during coupling. Preferably, said setting can be performed unambiguously. This means that with each setting solely one of the two or more possible mutually locked positions can be obtained.

Preferably, said coupling means substantially consist of a tongue and a groove, which in said mutually locked positions at least partially offer or effect said locking in vertical direction, wherein said tongue and groove preferably are provided with locking means, which in said mutually locked positions at least partially offer or effect said locking in horizontal direction. Preferably, said tongue, groove and locking means are made in one piece with the floor panel, whereas the adapting means either are made of a separate material, or also are made in one piece with the floor panel, preferably with the coupling means.

Such adapting means can be realized in a variety of ways.

According to a first possibility, said adapting means comprise one or more removable portions. With such embodiment, the application or non-application of the adapting means can be determined at least by removing or not removing one or more of the removable portions. Herein, said removable portions may consist of separate material portions, such as profiles, which can be provided at the respective coupling means and/or sides of the floor panel and/or can be removed therefrom, or may consist of removable material portions, which, however, are made in one piece with the respective coupling means and/or sides. In this last case, the adapting means can be removed, for example, by breaking, cutting, tearing off or the like.

According to a second possibility, said adapting means extend only over a portion of the respective sides, and the application or non-application thereof depends at least on the mutual longitudinal position of the respective floor panels, considered in longitudinal direction of the respective sides.

In other words, the adopted mutually locked position and the pertaining mutual distance between the upper edges, amongst others, in the above-mentioned second possibility, may depend at least on the mutual longitudinal position of the respective floor panels, considered in longitudinal direction of the respective sides. By means of such embodiment, in a very user-friendly manner, possibly without removing or providing material portions, two or more mutual positions can be adopted, in which a different distance between the upper edges of the floor panels is defined. Preferably, said adopted mutual position or the associated therewith mutual distance between the upper edges remains unaltered or at least virtually unaltered in a continuous interval of mutual longitudinal positions of the floor panel, considered in longitudinal direction of the respective sides. In this manner, the influence of the longitudinal position on the final distance between the upper edges can be restricted, whereby the risk of the occurrence of faults during installation can be restricted. In such case, the mutually locked position to be achieved each time can be set by means of the first floor panel of a respective row. Namely, the displacement in longitudinal direction of this first floor panel in respect to the already installed floor panels of an adjacent row can determine the displacement of the remaining floor panels in the row and therefore also their mutual position to be adopted. It is clear that the floor panels of a same row, and still better of the entire floor covering, with a same longitudinal displacement preferably obtain the same or at least practically the same mutually locked position, namely, with the same distance to the upper edges of floor panels of an adjacent row.

In connection with this second possibility, reference is also made to the patent documents WO 01/27410, DE 201 09 840 U1, WO 2005/003489, WO 2007/144403 and WO 2004/048716, from which floor panels are known, which allow a coupling at a pair of opposite sides by bringing the floor panels into an initial intermediary condition in which play and gaps are present between the floor panels, and wherein the floor panels, by means of a shifting movement along the respective side, are brought from the initial condition into the final locked position, in which neither play nor gaps are present between the floor panels. It is clear that the present invention differs from the patent documents mentioned here in that at least two different final mutually locked positions are possible and in that the mutually locked position to be adopted can be set by means of adapting means.

According to still a third possibility, said adapting means comprise deformable portions, such as compressible, extendable or bendable material portions. It is clear that by means of such deformation, depending on the fact whether it is already deformed or not, space may or may not be created by which a gap at the surface can be realized. Preferably, the adapting means in combination with such deformable portion comprise a rigid portion maintaining the deformation.

In a preferred embodiment of the first aspect, said adapting means, when they are applied, comprise at the respective sides horizontally active contact surfaces between both floor panels. So, for example, by means of the adapting means at least a horizontally active contact surface can be formed extending above said tongue, and/or at least a horizontally active contact surface can be formed which is situated at the underside of said tongue. This latter horizontally active contact surface then is situated preferably on said locking means. This preferred embodiment provides for that the adapting means can directly determine the mutual distance between the upper edges in the respective mutual position.

According to still another preferred embodiment of the present invention, the floor panels in said two or more mutually locked positions are coupled to each other free from play. The absence of play in the connection reduces the risk of a subsequent occurrence or increase of said mutual distance between the upper edges. This risk can be reduced even further when the floor panels, at least in one of the aforementioned two or more locked positions, and preferably in all such positions, show so-called "pre-tension". Coupling means which allow interconnecting floor panels with pre-tension are known as such from WO 97/47834. Such pre-tension can be achieved, for example, in the cases where said groove comprises an upper lip and a lower lip and where in at least one of said mutually locked positions the lower lip has been bent. Due to its elastic resilience, this lower lip can press against the tongue and try to press this tongue more tightly into the groove.

Preferably, the mutual distances between the upper edges in said two or more mutually locked positions are determined unambiguously. By this, it is meant that in this embodiment, a same application of the adapting means results in a same distance between the upper edges.

Preferably, the mutual distances between the upper edges in said two or more mutually locked positions are chosen from a discrete series. By this, it is meant that these distances are not continuously adjustable, however, are made adjustable with finite steps by means of the aforementioned adapting means.

In a practical embodiment of the present invention, in at least one of said locked mutual positions said distance between the upper edges of the respective floor panels is virtually zero millimeters or non-existent, or at least is smaller than 0.2 millimeters.

In still another practical embodiment, which possibly can be combined with the above, in at least one of said locked mutual positions said distance between the upper edges of the respective floor panels is larger than 0.2 millimeters, and preferably is smaller than 3 millimeters. Such distance is usable, for example, for imitating gaps which have occurred in antique floors, such as in parquet floors, due to the repeated expansion and shrinkage thereof.

Preferably, the invention can be applied for longitudinal rectangular floor panels. Preferably, said coupling means, adapting means and locking means then are present at least at the pair of long opposite sides, such that it is the mutual distance between the upper edges of the long sides of adjacent floor panels which can be set. At the other pair of sides, namely, the short pair of opposite sides, preferably no adapting means in the sense of the invention are present, although this is not excluded. Preferably, at the short side a whether or not connection by means free from play is provided, by means of mechanical coupling means, such as those known as such from WO 97/47834.

At the respective sides, the aforementioned coupling means preferably allow a connection with a similar floor panel by means of a turning movement around this side and/or by means of a horizontal shifting movement of the respective sides towards each other. Other ways of coupling, such as coupling by means of a downward movement with a so-called "push-lock", are not excluded.

According to an independent second aspect, the present invention relates to a floor panel of the type comprising, at least at two opposite sides, coupling means extending along these sides and allowing that two of such floor panels can adopt two or more different mutually locked positions, wherein, in these mutual positions, they can be coupled to each other such that therein a locking is obtained in a direction perpendicular to the plane of the floor panels as well as in a direction in the plane of the floor panels and perpendicular to the coupled edges, wherein said two or more mutual positions differ from each other, on the one hand, in that, at the coupled sides, they define two or more different distances between the upper edges of the floor panels, and, on the other hand, in that the respective floor panels, considered in longitudinal direction of the respective sides, adopt different longitudinal positions, with the characteristic that said mutually locked positions, each time over an interval of said longitudinal positions, define the same or virtually the same distances between the upper edges of the floor panels.

According to an independent third aspect, the present invention relates to a floor panel of the type comprising, at least at two opposite sides, coupling means extending along these sides and allowing that two of such floor panels can adopt two or more different mutually locked positions, wherein, in these mutual positions, they can be coupled to each other such that therein a locking is obtained in a direction perpendicular to the plane of the floor panels as well as in a direction in the plane of the floor panels and perpendicular to the coupled edges, wherein said two or more mutual positions differ from each other, on the one hand, in that, at the coupled sides, they define two or more different distances between the upper edges of the floor panels, and, on the other hand, in that the respective floor panels, considered in longitudinal direction of the respective sides, adopt different longitudinal positions, with the characteristic that the floor panels, in said two or more different mutually locked positions, are coupled to each other free from play.

It is clear that said second and third aspects relate to portrait definitions of preferred embodiments of the first aspect, wherein the term adapting means applied therein is defined more detailed. For further possible characteristics of such floor panel, thus, reference is made to the first aspect.

According to a fourth aspect, the invention also relates to a floor covering, with the characteristic that it is composed by means of floor panels showing the characteristics of the first, second and/or third aspect and/or the preferred embodiments thereof. Such floor covering preferably is composed of rows of said floor panels, wherein all floor panels from a same row adopt the same mutually locked position, such that along this row a constant or virtually constant mutual distance is present between the upper edges of the floor panels.

Further, according to a fifth aspect, the invention also relates to a method for manufacturing floor panels with the characteristics of the first, second and/or third aspect, with the characteristic that said coupling means, adapting means and locking means are realized at least by means of a machining treatment with rotating milling tools, wherein at least one of said milling tools removes an amount of material varying along the respective side. Preferably, said milling tool performs a reciprocating or tilting movement, which is synchronized with the feeding movement of the floor panel to be processed. By the synchronization, it can be obtained that floor panel after floor panel each time the same amount of material is machined away along the respective side. Thus, the method of the fifth aspect is particularly suited for realizing adapting means meeting the characteristics of the second possibility therefor mentioned in the first aspect.

It is noted that there, where herein above a mutual distance between the upper edges of the coupled floor panels is mentioned, this distance does not necessarily have to be fixed, but also can be freely selectable over a certain interval, i.e. non-adjustable. Preferably, such intervals do not overlap each other in the different mutual positions, or maximum halfway only. In the case of floor panels with the characteristics of the first and/or the second and/or the third aspect, it is rather the intervals that are selected or set by means of the adapting means.

It is noted that the invention according to all its aspects in particular relates to laminate floor coverings or laminate floor panels for such coverings, wherein these floor panels substantially consist of a substrate and a top layer provided on this substrate, on the basis of synthetic material, which shows a printed decor. Said decor may be printed directly on the substrate, whether or not with the intermediary of primer layers. However, the decor may also be provided on a material sheet, such as a paper sheet, which is included in said top layer. Further, the top layer may also comprise a protective layer, which is situated above the printed decor and which comprises, for example, wear-resistant particles, such as aluminum oxide. It is not excluded that this protective layer also comprises a material sheet, such as a paper sheet. Such laminate floor panel may be manufactured, for example, according to a DPL (Direct Pressure Laminate) or HPL (High Pressure Laminate) technique. In the case of a DPL technique, one or more material sheets provided with resin are brought, together with the substrate, into a press device, where, under the influence of increased pressure and temperature, they are connected to each other as well as to the substrate. In the case of a HPL technique, the top layer is formed separately on the basis of two or more material sheets provided with resin, prior to providing the thus obtained top layer on the substrate, for example, by gluing it onto the substrate.

It is clear that the invention is not limited to laminate floor panels, but relates to any kind of floor panels. For example, it may also be applied to floor panels with a wooden top layer, such as veneer parquet, so-called "Engineered Wood" comprising a thicker wooden top layer which can be re-ground, or solid parquet.

BRIEF DESCRIPTION OF THE DRAWINGS

With the intention of better showing the characteristics of the invention, hereafter, as an example without any limitative character, several preferred embodiments are described, with reference to the accompanying drawings, wherein.

DETAILED DESCRIPTION OF PREFERRED EMBODIMENTS OF THE INVENTION

Figure 1:
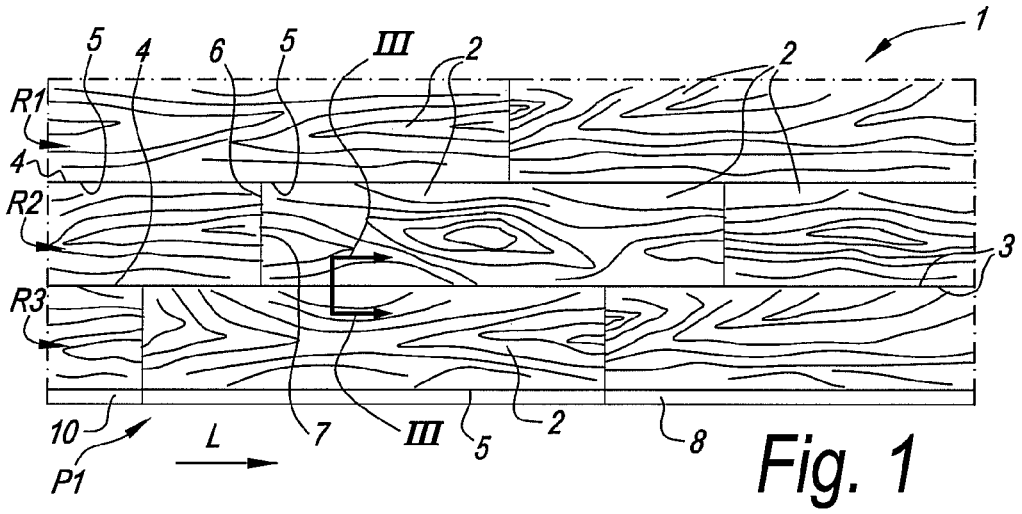
FIG. 1 represents a floor covering composed by means of floor panels showing the characteristics of the invention.

FIG. 1 represents a floor panel 1 wherein the floor panels 2 of the invention adopt mutually coupled positions P1, wherein the upper edges 3 of their adjacent coupled sides 4-5 adjoin each other, or at least fit against each other without a visible distance or gap. Here, oblong floor panels 2 are concerned, wherein the adjacent long sides 4-5 as well as the adjacent short sides 6-7 of these floor panels 2 fit against each other.

Figure 2:
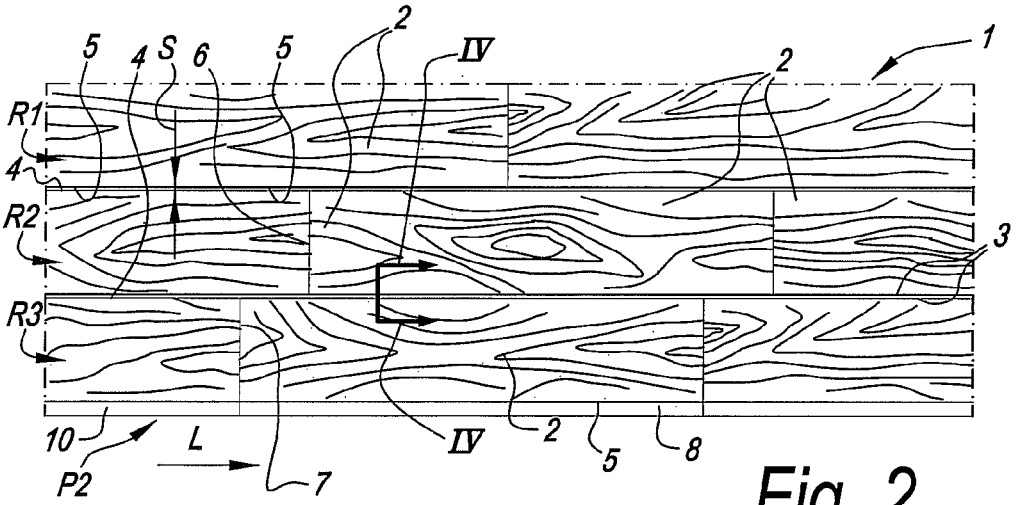
FIG. 2 represents another floor covering which is composed from the same floor panels as in FIG. 1.

FIG. 2 represents that the floor panels 2 from FIG. 1 can also be applied for composing a floor covering 1 in which these floor panels 2 adopt other mutually coupled positions P2, wherein the upper edges 3 of their adjacent coupled long sides 4-5 do not fit against each other, but wherein the floor panels 2 at these coupled long sides 4-5 define a visible distance or gap S between their upper edges 3.

Figure 3:
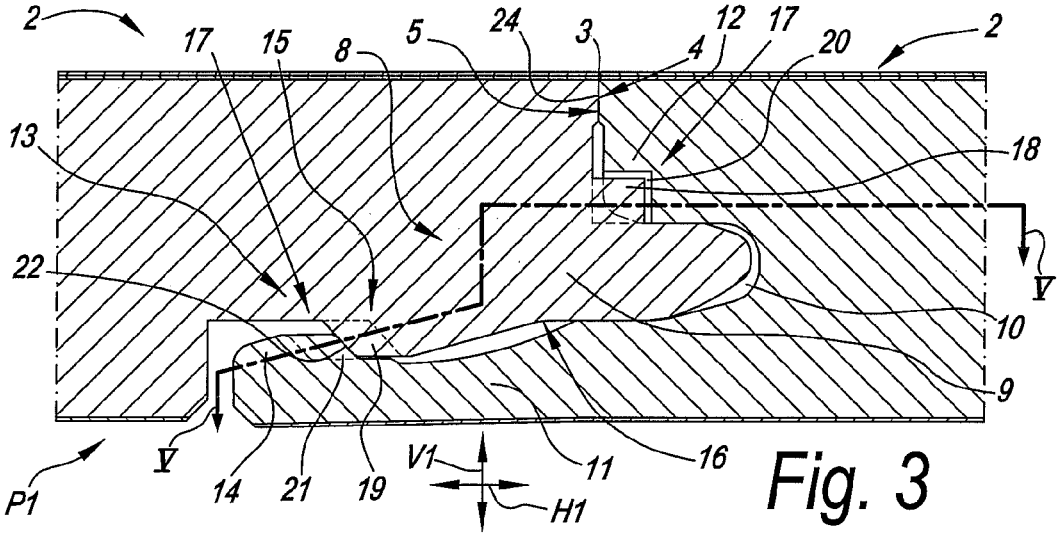
FIGS. 3 and 4 represent, at a larger scale, cross-sections according to the lines indicated in FIG. 1 by III-III and in FIG. 2 by IV-IV, respectively.

FIG. 3 represents how the floor panels 2 from FIG. 1 cooperate with each other in case they adopt a mutually coupled position P1, in which the upper edges 3 adjoin each other without a visible gap.

Figure 4:
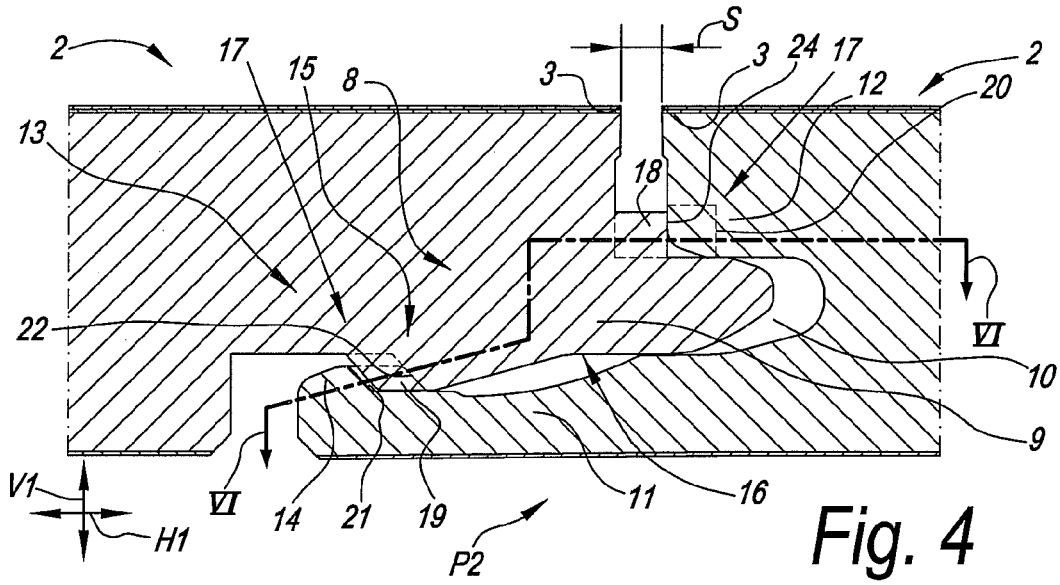

FIG. 4 represents how the floor panels 2 from FIG. 2 cooperate with each other in the case that they adopt the other mutually coupled position P2, namely the position P2 in which a visible distance S is present between the upper edges 3 of adjacent sides 4-5.

FIGS. 3 and 4 clearly show that the floor panels 2 are of the type having at least at two opposite sides 4-5 and/or 6-7 coupling means 8, which allow adopting at least the aforementioned two mutually locked positions P1-P2. In each of these mutually coupled positions P1-P2, they are coupled to each other such that thereby a locking of the floor panels 2 is obtained in a vertical direction V1 perpendicular to the plane of the coupled floor panels 2 as well as in a horizontal direction H1 in the plane of the floor panels 2 and perpendicular to the coupled sides 4-5. The coupling means 8 applied here substantially consist of a tongue 9 and a groove 10, which, in said mutually locked or coupled positions P1-P2, effect at least partially said locking in vertical direction V1. The groove 10 is bordered by a lower lip 11 and an upper lip 12. This tongue 9 and groove 10 are provided with locking means 13 effecting at least partially said mutual locking in horizontal direction H1. In this case, the locking means 13 comprise an upright portion 14 of the lower lip 11 and a portion 15 cooperating therewith at the underside 16 of the tongue 10.

FIGS. 3 and 4 clearly show that in this embodiment in both mutually locked positions P1-P2 a locking, more particularly in horizontal direction H1, without play is obtained.

As already has become evident from FIGS. 1 and 2, said mutually coupled positions P1-P2 differ from each other in that they define, at the respective coupled sides 4-5, different distances S between the upper edges 3 of the floor panels 2. In the present case, in one of the mutually coupled positions P1 even no or almost no distance S is present between the upper edges 3.

The particularity of the floor panels 2 of the present invention is that the mutually locked position P1-P2 to be adopted, or the distance S between the upper edges 3, which must be obtained in the locked position P1-P2, can be set by application or non-application of adapting means 17, which are present at said coupling means 8.

In the example of FIGS. 3 and 4, the adapting means 17 are realized according to the second possibility therefor mentioned in the introduction. They extend over only a portion of the respective side 4-5, and the application or non-application thereof at least depends on the mutual longitudinal position of the respective floor panels 2, considered in longitudinal direction L of the respective sides 4-5. This is also clearly represented when comparing FIGS. 1 and 2; in FIG. 2, the floor panels from the rows R2 and R3 each time are shifted in longitudinal direction L in respect to the position of these floor panels 2 in the rows R2 and R3 from FIG. 1. More precisely, the adapting means 17 of the example comprise local protrusions 18-19 at the tongue side. Namely, in this case a first local protrusion 18 at the upper side of the tongue 9, and a second local protrusion 19 at the underside 16 of the tongue 9 at the location of said locking element 15. At the groove side, the adapting means 17 comprise corresponding recesses 20-21, namely, a first recess 20 at the upper side of the groove 10 in said upper lip 12 thereof and a second recess 21 at the location of said locking element 14, which is formed at the lower lip 11 of the groove 10, respectively.

Depending on whether said corresponding protrusions 18-19 and recesses 20-21 can be provided in each other or not, in the coupled position P1-P2 a gap S is present or absent between the corresponding upper edges 3 of the floor panels 2.

Figure 5:
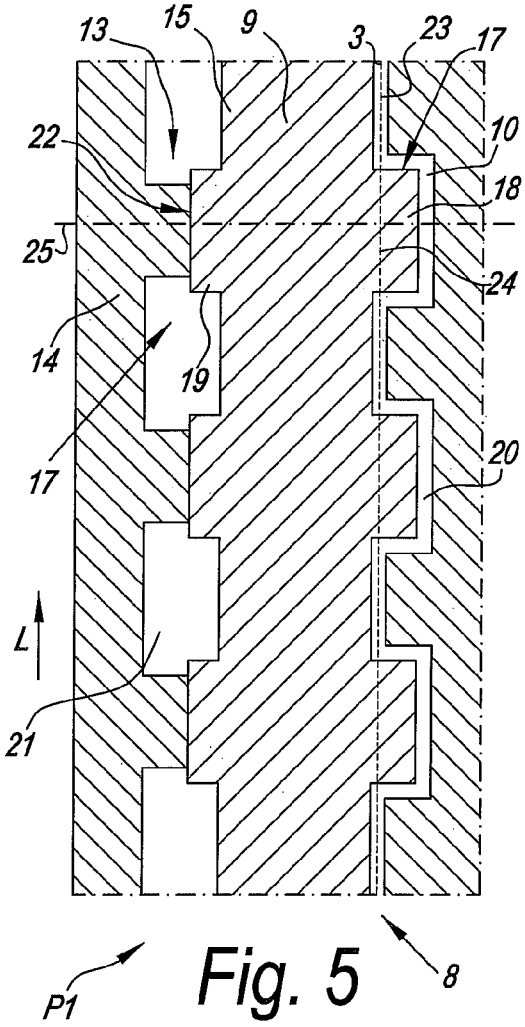
FIGS. 5 and 6, schematically and at another scale, represent horizontal cross-sections according to the lines indicated in FIG. 3 by V-V and in FIG. 4 by VI-VI, respectively.

FIG. 5 schematically represents a horizontal cross-section through the coupling means 8, and in particular through the adapting means 17, in the case that in the mutually locked position P1 the respective upper edges 3 fit against each other. In this position P1, the protrusion 18 at the upper side of the tongue 9 and the recess 20 in the upper lip 12 of the groove 10 are provided in each other, whereas the protrusion 19 at the underside 16 of the tongue 9 comes into contact with the actual locking element or upright portion 14 at the lower lip 11, or, in other words, thus is not provided in the corresponding recess 21 at the location of this locking element 14. Said contact at the underside 16 of the tongue 9 with the actual locking element 14 provides for a horizontally active contact surface 22. This surface 22 prevents the moving apart of the floor panels 2 in horizontal direction H1. The dashed vertical line 23 represents the position of the upper edges 3 of both floor panels 2. It is clear that in this case, these edges fit against each other. The fitting against each other upper edges 3 as such also form horizontally active contact surfaces 24, which prevent that the floor panels 2 move towards each other. Also, for clearness' sake, by the dash-dotted line 25, the position is indicated which corresponds to the cross-section of FIG. 3.

Figure 6:
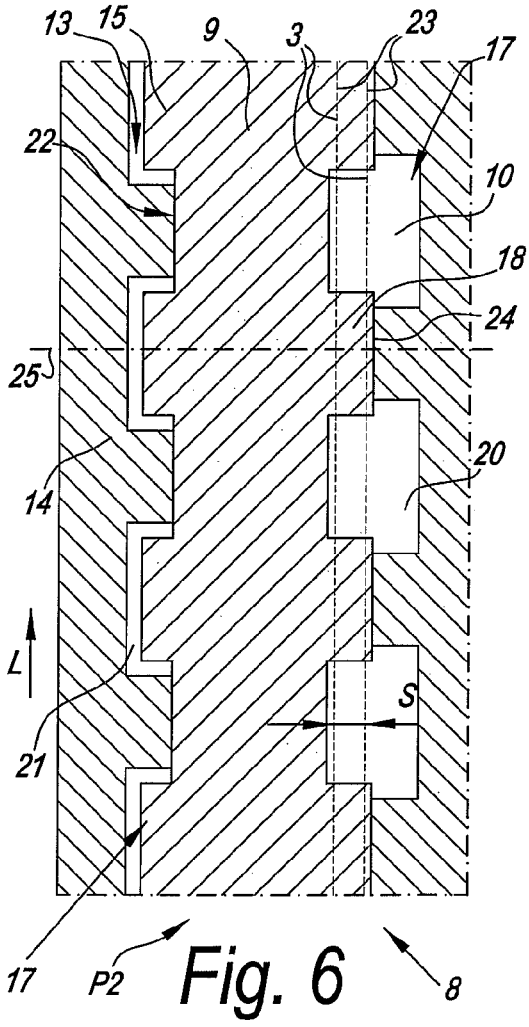

FIG. 6 schematically represents a horizontal cross-section through the coupling means 8, and in particular through the adapting means 17, in the case that in the mutually locked position P2 between the respective upper edges 3 a visible distance S is present. In this position P2, the protrusion 19 at the underside 16 of the tongue 9 and the recess 21 in the locking element 14 of the lower lip 11 are provided in each other, whereas the protrusion 18 at the upper side of the tongue 9 makes contact 24 with the actual upper lip 12 of the groove 10, or, in other words, thus is not provided in the corresponding recess 20 provided in the upper lip 12. Said contact 24 at the upper lip 24 of the groove 10 provides for a horizontally active contact surface 24. This surface 24 prevents that the floor panels 2 move towards each other in horizontal direction H2. By the dashed vertical lines 23, the position of the upper edges 3 of both floor panels 2 is represented. It is clear that they are positioned at a distance S from each other. Also, for illustrations' sake, by the dash-dotted line 25 the position is represented which corresponds to the cross-section of FIG. 4. It is noted that in the represented position P2, there are also horizontally active contact surfaces 22, which prevent that the floor panels 2 move away from each other. These are formed between the actual locking element 14 on the lower lip 11 and the cooperating therewith locking element 14 at the underside of the tongue 9. It is clear that in the example the two aforementioned horizontally active contact surfaces 22-24 are formed in a different cross-section.

From the comparison of FIGS. 5 and 6, it again becomes clear that said different mutually locked positions P1-P2 can be adopted or set by selecting the shifting in longitudinal direction L of both floor panels 2. In this case, this even relates to an unambiguous setting, which means that the obtained distance S between the respective upper edges 3 is unambiguously linked to the longitudinal position of the floor panels 2. In the example, the distances S also are chosen from a discrete series. This means that they are not continuously adjustable, but have to be selected from only two possible values.

FIGS. 5 and 6 also make clear that the adopted mutual position P1-P2 or the associated therewith mutual distance S between the upper edges 3 remains unaltered in a continuous interval of longitudinal positions of the floor panel 2, considered in the longitudinal direction L of the respective sides 4-5. This means that with a possible, albeit limited, longitudinal shifting of the floor panels 2 of FIGS. 5 and 6, the same mutually locked position P1-P2 is maintained. This is advantageous, for example, when a shifting in coupled condition is desirable for connecting the remaining sides 6-7 of one or more of these floor panels 2. The possibility of such shifting is desirable, for example, at the long opposite sides 4-5 of a floor panel 2, when this floor panel 2 at its opposite short sides 6-7 has coupling means 8, which can be coupled by means of a turning and/or horizontal shifting movement.

Figure 7:
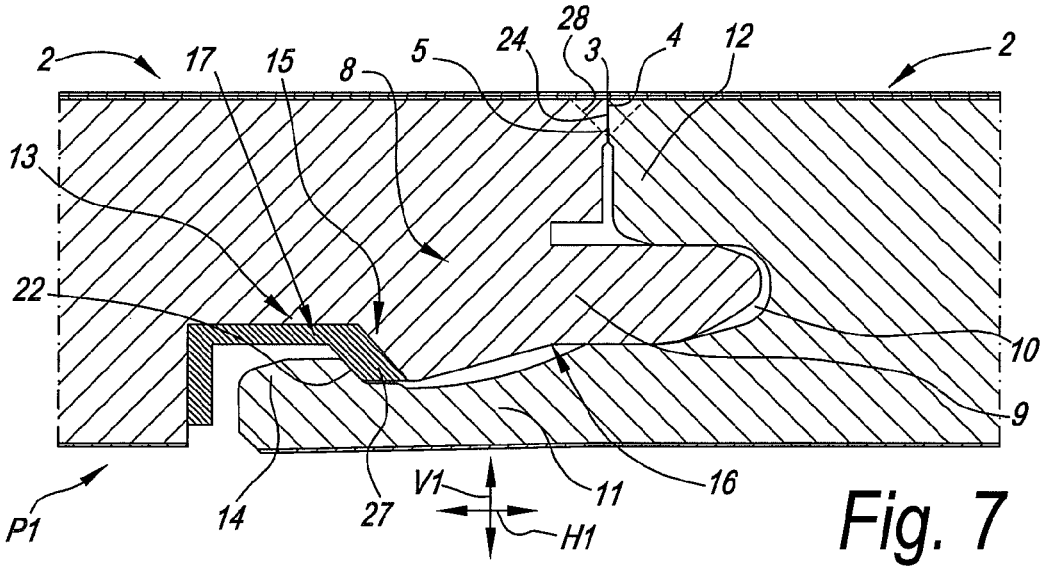
FIGS. 7 and 8 represent similar views as FIGS. 3 and 4, however, for a variant.
Figure 8:
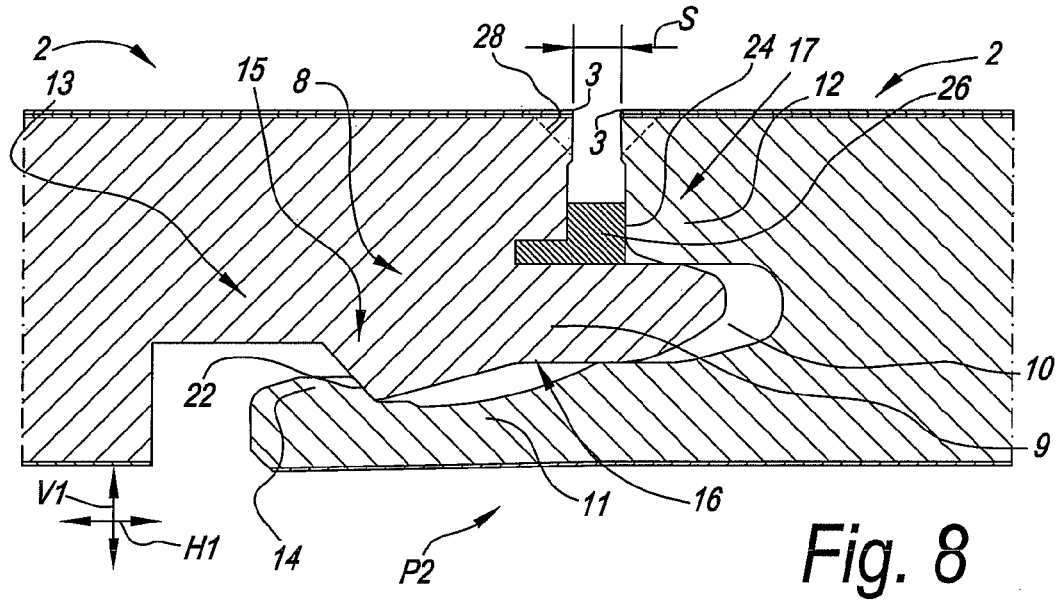

FIG. 7 represents a variant of the floor panels 2 from the FIGS. 1 through 6 in a first possible coupled position P1, and FIG. 8 represents this variant in a second possible coupled position P2.

In this variant, the adapting means 17 comprise one or more, in this case two, removable portions 26-27. In the example, the removable portions 26-27 are made as profiles, which can extend at least along a portion of the length of the respective side 4-5. Such profile may be, for example, an elongated profile, however, such profile may also consist of one or more separate clips, which then can be provided locally along the respective side 4-5. According to still another variant, one or more of such removable portions 26-27 are formed by a kneadable or otherwise deformable material. According to still another possibility, one or more of such removable portions 26-27 initially can be made in one piece with, however, removable from the coupling means 8.

In the example, the application or non-application of the adapting means 17 is determined by whether or not removing or by whether or not applying one or more of the aforementioned removable portions 26-27.

In the position P1 represented in FIG. 7, the upper edges 3 of the floor panels 2 fit against each other in that a separate profile is applied at the location of the locking element 14 at the lower lip 11 and/or at the cooperating therewith locking element 15 at the underside 16 of the tongue 9.

In the locked position P2 represented in FIG. 8, a visible distance S is present between the upper edges 3 of the respective floor panels 2, as a separate profile is applied above the tongue 9 and adjoining to the upper lip 12 of the groove 10.

It is noted that, when removable portions 26-27 are mentioned, it is not excluded that such portion 26-27 is fixedly connected to the floor panel 2 when installing the floor panels 2, for example, by adhering it or by fixedly connecting it to this floor panel 2 in any other manner. Thus, by removable is meant that this is removable when the floor panels 2 are delivered, which does not exclude that this portion 26-27 can be provided at the floor panels 2 with detachable connections, such as with a detachable adhesive connection or a mechanical connection.

It is noted that the removable portions 26-27 or separate profiles from the FIGS. 7 and 8 possibly may have the same shape or cross-section, such that only one of such removable portions 26-27 has to be provided, which can fulfill the function of both portions 26-27.

Referring to FIGS. 3 and 4, as well as to FIGS. 7 and 8, it is also noted that the aforementioned lower lip 11 is bent. Such bent-out lower lip 11 can effect a certain tension in the coupling means 8, as a consequence of which an especially strong coupling is obtained. It is possible that the bending-out of this lower lip 11 is applied for realizing additional space at the locking element 14 of this lower lip 11 in the mutually locked position P2, whereby a distance S is present between the upper edges 3. In FIGS. 4 and 8, such space is realized at the location of this locking element 14 or by removing said profile at the location of this locking element 14. Of course, it is possible that in the variant of FIGS. 7 and 8, only the profile situated above said tongue 9 is used and that the rearward displacement of the tongue panel in FIG. 8 is made possible by bending-out said lower lip 11. In such embodiment, exclusively the profile situated above said tongue 9 can be used.

As mentioned in the introduction, also deformable portions can be used, which then, for example, may offer said additional space.

It is clear that the embodiments represented in the figures show the characteristics of the first, the second as well as the third aspect of the invention.

Further, it is clear that the floor covering 1 represented in FIG. 2 also shows the characteristics of the fourth aspect mentioned in the introduction, namely, that it is composed of rows of floor panels 2 showing the characteristics of the invention, wherein all floor panels 2 from the same row R1-R2-R3 adopt the same mutually locked position P2, such that along this row a constant or virtually constant mutual distance S is present between the upper edges 3 of the floor panels 2.

It is also clear that the floor panels 2, which are represented in the FIGS. 3 through 5, can be manufactured by a method showing the characteristics of the fifth aspect mentioned in the introduction. The synchronization mentioned in this context allows obtaining each time identical floor panels 2, in particular obtaining floor panels 2, wherein the adapting means 17 extend along the respective side 4-5 in an identical manner. Such floor panels 2 allow a smooth assembly of a floor covering 1 with the characteristics of the fourth aspect.

Generally, it is also noted that, when the floor panels 2 of the invention are equipped with chamfers 28, such as bevels, it is presumed according to the invention that the upper edges 3 extend beneath these chamfers 28, as represented in FIGS. 7 and 8 by means of the bevels indicated in dashed line.

The present invention is in no way limited to the above-described embodiments; on the contrary may such floor panels, floor coverings and methods be realized according to various variants, without leaving the scope of the present invention.

The invention claimed is:

1. A floor panel comprising at least two opposite side edges and cooperating pairs of coupling parts at the two opposite side edges;

the panel including upper side edges terminating at or adjacent said opposite side edges;

said coupling parts enabling two of such floor panels to be coupled by a pair of the coupling parts along one pair of the opposite side edges in two or more different mutually locked positions such that a locking against motion between the coupled panels is obtained in a vertical direction perpendicular to a principal plane of the floor panels, and in a horizontal direction parallel to the principal plane of the floor panels and perpendicular to the coupled side edges;

wherein said two or more mutually locked positions differ from each other in that they define two or more different distances between upper side edges of coupled floor panels; and adapter elements associated with said coupling parts, so that the selective use and non-use of said adapter elements in a cooperating relationship with the coupling parts enables setting of the mutually locked position of the coupled panels at said two or more different mutually locked positions with varying distances between the panel upper edges, said setting defining the eventual position in which the coupled panels are locked relative to one another, wherein the adapter elements include a rigid portion such that in said eventual position the respective coupling parts are arranged for being prevented from further insertion into one, and wherein in each of said two or more different mutually locked positions, corresponding horizontally active contact surfaces lock the coupled panels relative to one another in the horizontal direction and prevent play in a first horizontal direction along the horizontal direction and prevent play in a second horizontal direction along the horizontal direction, the first horizontal direction being opposite from the second horizontal direction.

2. The floor panel of claim 1, wherein said adapter elements are arranged to be selectively removable from positions when they are in cooperative relationship with the coupling parts to positions separate from the panels and not in cooperative relationship with the coupling parts.

3. The floor panel of claim 1, wherein said adapter elements constitute part of each floor panel in association with the coupling parts and are configured so they have a length that extends only over a portion of the respective side edges, and wherein the use or non-use of the adapter elements in cooperative relationship with the coupling parts at least is determined by the mutual longitudinal positions of two coupled floor panels along a longitudinal direction of the side edges.

4. The floor panel of claim 1, wherein said adapter elements define horizontally active contact surfaces between a pair of floor panels when the panels are coupled.

5. The floor panel of claim 1, wherein the floor panels in said two or more mutually locked positions are coupled to each other without play.

6. The floor panel of claim 1, wherein the varying distances between the upper side edges of coupled panels in said two or more mutually locked positions is pre-set.

7. The floor panel of claim 1, wherein the varying distances between the upper side edges of coupled panels in said two or more mutually locked positions are selectable from a discrete series of available distances.

8. The floor panel of claim 1, wherein the mutually locked positions and the associated distances between the upper side edges of coupled panels at the mutually locked positions at least depends on the relative longitudinal positions of coupled floor panels relative to each other along a longitudinal direction of the respective side edges.

9. The floor panel of claim 8, wherein said mutually locked positions or the associated distances between the upper side edges of coupled panels at the mutually locked positions remains virtually unaltered along a continuous interval of mutually locked positions of coupled panels along the longitudinal direction of the respective side edges.

10. The floor panel of claim 1, wherein said coupling parts comprise a tongue and a groove which, in said mutually locked positions of coupled panels, at least partially effect said locking in vertical direction, and wherein said tongue and groove are provided with locking elements which, in said mutually locked positions, at least partially effect said locking in the horizontal direction.

11. The floor panel of claim 10, wherein said groove comprises an upper lip and a lower lip, wherein in at least one of the mutually locked positions of coupled panels, the lower lip is bent from an uncoupled position of the lower lip.

12. The floor panel of claim 1, wherein in at least one of said locked mutual positions, said distance between the upper side edges of coupled floor panels is zero to 0.2 millimeters.

13. The floor panel of claim 1, wherein in at least one of said locked mutual positions, said distance between the upper side edges of coupled floor panels is 0.2 to 3 millimeters.

14. The floor panel of claim 1, wherein the floor panels are oblong rectangular panels having a longer opposite pair of side edges relative to a pair of opposite end edges, and wherein said coupling parts and adapter elements are provided at least at the longer pair of opposite side edges.

15. A floor panel comprising at least two opposite side edges and cooperating coupling parts extending along the opposite side edges, the cooperating coupling parts being configured to enable a pair of such floor panels to be coupled to each other along a mutual pair of the opposite side edges, said coupling parts further configured so as to enable such coupled panels to adopt two or more different mutually locked coupled positions;

the panel including opposite upper side edges terminating at or adjacent the opposite side edges;

wherein, in the mutually locked positions, a locking is obtained in a vertical direction perpendicular to a principal plane of the coupled floor panels and in a horizontal direction parallel to the principal plane of the coupled floor panels and perpendicular to the coupled side edges;

said two or more mutually locked positions differing from each other in that they define at the coupled side edges two or more different distances between the upper side edges of a pair of coupled panels, and, with regard to the longitudinal direction of the respective coupled side edges of the coupled panels, they define different longitudinal positions;

each said mutually locked positions defining a corresponding distance between the upper side edges of a pair of coupled floor panels, each distance being constant or virtually constant over the interval of the respective longitudinal position, wherein the pair of coupled panels are arranged to be set at the eventual position in which the pair of coupled panels are locked relative to one another, and wherein in each of said two or more different mutually locked positions, corresponding horizontally active contact surfaces lock the coupled panels relative to one another in the horizontal direction and prevent play in a first horizontal direction along the horizontal direction and prevent play in a second horizontal direction along the horizontal direction, the first horizontal direction being opposite from the second horizontal direction.

16. A floor panel comprising at least two opposite side edges and cooperating coupling parts extending along the opposite side edges, the cooperating coupling parts being configured to enable a pair of such floor panels to be coupled to each other along a mutual pair of the opposite side edges, said coupling parts further configured so as to enable such coupled panels to adopt two or more different mutually locked coupled positions;

the panel including opposite upper side edges terminating at or adjacent the opposite side edges;

wherein, in the mutually locked positions, a locking is obtained in a vertical direction perpendicular to a principal plane of the coupled floor panels and in a horizontal direction parallel to the principal plane of the coupled floor panels and perpendicular to the coupled side edges;

said two or more mutually locked positions differing from each other in that they define at the coupled side edges two or more different distances between the upper side edges of a pair of coupled panels, and, with regard to the longitudinal direction of the respective coupled side edges of the coupled panels, enable positioning of the coupled panels at different relative longitudinal positions;

wherein the floor panels in said two or more mutually locked positions are coupled to each other without play;

wherein the pair of coupled panels are arranged to be set at the eventual position in which the pair of coupled panels are locked relative to one another, and wherein in each of said two or more different mutually locked positions, corresponding horizontally active contact surfaces lock the coupled panels relative to one another in the horizontal direction and prevent play in a first horizontal direction along the horizontal direction and prevent play in a second horizontal direction along the horizontal direction, the first horizontal direction being opposite from the second horizontal direction.

17. Floor covering, said floor covering comprising floor panels according to any one of claim 1, 15 or 16.

18. The floor covering of claim 17, comprising rows of said floor panels, wherein all floor panels of a same row adopt the same mutually locked position, such that along the row, a constant or virtually constant mutual distance is present between the upper side edges of the coupled floor panels.

19. Method for manufacturing floor panels of claim 1, wherein said coupling parts and adapter elements are formed at least by means of a machining treatment with rotating milling tools, and wherein at least one of said milling tools removes a varying amount of material along a respective panel side edge.

20. The method of claim 19, wherein said milling tool performs a reciprocating or tilting movement, which is synchronized with a feeding movement of the floor panel having the coupling parts and adapter elements to be formed.

21. The floor panel of claim 1, wherein the adapter element is formed from a separate material portion from the floor panel.

22. The floor panel of claim 15 or 16, further comprising adapting means associated with the coupling parts and extending over only a portion of a length of a respective floor panel side, application or non-application of the adapting means depending on the mutual longitudinal position of pair of coupled panels.

23. The floor panel of claim 1, 15 or 16, wherein in said eventual position the respective coupling parts are arranged for being prevented from further insertion into one another by at least one horizontally active contact surface, the coupling parts comprise a tongue and a groove which, in said mutually locked positions of coupled panels, at least partially effect said locking in vertical direction, and wherein said tongue and groove are provided with locking elements which, in said mutually locked positions, at least partially effect said locking in the horizontal direction, wherein the at least one horizontally active contact surface is formed at the groove and remains intact in the eventual position.

24. The floor panel of claim 23, wherein the groove further includes an upper lip and a lower lip, the at least one horizontally active contact surface is formed at the upper lip.

* * * * *

UNITED STATES PATENT AND TRADEMARK OFFICE

CERTIFICATE OF CORRECTION

PATENT NO. : 9,151,062 B2
APPLICATION NO. : 12/934874
DATED : October 6, 2015
INVENTOR(S) : Capelle et al.

It is certified that error appears in the above-identified patent and that said Letters Patent is hereby corrected as shown below:

Title Page

Add Item (30), Foreign Application Priority Data, BE 2008/0232 filed 04/16/2008

Signed and Sealed this
Fifth Day of April, 2016

Michelle K. Lee

Michelle K. Lee
*Director of the United States Patent and Trademark Office*